US006533925B1

(12) United States Patent
Wallace et al.

(10) Patent No.: US 6,533,925 B1
(45) Date of Patent: Mar. 18, 2003

(54) ASPHALT AND RESIN PRODUCTION TO INTEGRATION OF SOLVENT DEASPHALTING AND GASIFICATION

(75) Inventors: Paul S. Wallace, Katy, TX (US); Kay A. Johnson, Missouri City, TX (US); Clint F. Penrose, Houston, TX (US); Jacqueline G. Niccum, Houston, TX (US)

(73) Assignee: Texaco Development Corporation, San Ramon, CA (US)

( * ) Notice: Subject to any disclaimer, the term of this patent is extended or adjusted under 35 U.S.C. 154(b) by 76 days.

(21) Appl. No.: 09/643,444

(22) Filed: Aug. 22, 2000

(51) Int. Cl.[7] ..... C10C 3/04; C10C 3/08

(52) U.S. Cl. ..... 208/309; 208/40; 208/44; 208/45; 208/86; 208/87

(58) Field of Search ..... 208/40, 44, 45, 208/86, 87, 309

(56) References Cited

U.S. PATENT DOCUMENTS

| | | | | |
|---|---|---|---|---|
| 3,617,481 A | | 11/1971 | Voorhies, Jr. et al. | 208/50 |
| 3,775,292 A | | 11/1973 | Watkins | 208/86 |
| 3,968,023 A | | 7/1976 | Yan | 208/86 |
| 4,017,383 A | | 4/1977 | Beavon | 208/309 |
| 4,099,382 A | | 7/1978 | Paull et al. | 60/648 |
| 4,101,415 A | | 7/1978 | Crowley | 208/45 |
| 4,125,458 A | | 11/1978 | Bushnell et al. | 208/309 |
| 4,178,758 A | | 12/1979 | Paull et al. | 60/648 |
| 4,239,616 A | | 12/1980 | Gearhart | 208/309 |
| 4,290,880 A | | 9/1981 | Leonard | 208/309 |
| 4,391,701 A | | 7/1983 | Le Page et al. | 208/370 |
| 4,454,023 A | | 6/1984 | Lutz | 208/96 |
| 4,455,219 A | | 6/1984 | Janssen et al. | 208/131 |
| 4,472,936 A | * | 9/1984 | Uchiyama et al. | 60/39.12 |
| 4,518,487 A | | 5/1985 | Graf et al. | 208/131 |
| 4,686,028 A | | 8/1987 | Van Driesen et al. | 208/86 |
| 4,767,521 A | | 8/1988 | Feldman et al. | 208/85 |
| 5,013,427 A | | 5/1991 | Mosby et al. | 208/211 |
| 5,124,026 A | | 6/1992 | Taylor et al. | 208/309 |
| 5,124,027 A | | 6/1992 | Beaton et al. | 208/309 |
| 5,145,574 A | | 9/1992 | Hedrick | 208/45 |
| 5,413,702 A | | 5/1995 | Yan | 208/97 |
| 5,919,355 A | | 7/1999 | Hood | 208/309 |
| 5,925,236 A | | 7/1999 | Fersing et al. | 208/131 |
| 5,976,361 A | | 11/1999 | Hood et al. | 208/309 |
| 6,048,447 A | | 4/2000 | Hayner et al. | 208/39 |

FOREIGN PATENT DOCUMENTS

| | | |
|---|---|---|
| WO | WO 00/06670 | 2/2000 |

* cited by examiner

*Primary Examiner*—Walter D. Griffin
*Assistant Examiner*—Tam M. Nguyen
(74) *Attorney, Agent, or Firm*—Morris N. Reinisch; Frank C. Turner; Howrey, Simon, et al.

(57) ABSTRACT

This invention involves heat integration of a solvent deasphalting process with a gasification process and an improved process for separating a resin phase from a solvent solution comprising a solvent, deasphalted oil (DAO) and resin. This improved process comprises heating the solvent solution so as to precipitate the resin from the solvent solution, and then separating the resin and some solvent from the solvent solution. This will produce a resin product and a mixture comprising the DAO and the remaining solvent. The DAO/solvent mixture is then boiled so as to vaporize a fraction of the solvent, with waste heat from a gasification unit providing the heat source for the boiling. The vaporized solvent is removed from the DAO/solvent mixture leaving a resin-free DAO product that contains any unvaporized solvent. The vaporized solvent is used for heating the aforementioned solvent solution and preheating the resin-free DAO/solvent mixture. The solvent solution heating and DAO/solvent mixture preheating steps are usually done in series, where the DAO/solvent mixture is first preheated prior to the boiling step leaving a cooled vaporized solvent fraction. The cooled vaporized solvent fraction is then used to provide the heat to the solvent solution prior to the resin separation step. The asphalt that is recovered in the deasphalting step is then used as feedstock in the gasification process.

26 Claims, 2 Drawing Sheets

ASPHALT AND RESIN PRODUCTION TO INTEGRATION OF SOLVENT DEASPHALTING AND GASIFICATION

BACKGROUND OF THE INVENTION

Conventionally, a solvent deasphalting (SDA) process is employed by an oil refinery for the purpose of extracting valuable components from a residual oil feedstock, which is a heavy hydrocarbon produced as a by-product of refining crude oil. The extracted components are fed back to the refinery wherein they are converted into valuable lighter fractions such as gasoline. Suitable residual oil feedstocks which may be used in a SDA process include, for example, atmospheric tower bottoms, vacuum tower bottoms, crude oil, topped crude oils, coal oil extract, shale oils, and oils recovered from tar sands.

In a typical SDA process, a light hydrocarbon solvent is added to the residual oil feed from a refinery and is processed in what can be termed as an asphaltene separator. Common solvents used are methane, ethane, propane, butane, isobutane, pentane, isopentane, neopentane, hexane, isohexane, heptane, their mono-olefinic counterparts thereof, and similar known solvents used in deasphalting, and mixtures thereof. Under elevated temperature and pressures, the mixture in the asphaltene separator separates into a plurality of liquid streams, typically, a substantially asphaltene-free stream of deasphalted oil (DAO), resins and solvent, and a mixture of asphaltene and solvent within which some DAO may be dissolved. The SDA process is a well-known petroleum process and is described in U.S. Pat. No. 3,968,023 to Yan, U.S. Pat. No. 4,017,383 to Beavon, U.S. Pat. No. 4,125,458 to Bushnell, all incorporated herein by reference, and numerous others.

Once the asphaltenes have been removed, the substantially asphaltene-free stream of DAO, resins and solvent is normally subjected to a solvent recovery system. The solvent recovery system of an SDA unit extracts a fraction of the solvent from the solvent rich DAO by boiling off the solvent, commonly using steam or hot oil from fired heaters. The vaporized solvent is then condensed and recycled back for use in the SDA unit.

Often it becomes beneficial to separate a resin product from the DAO/resin product stream. This is normally done before the solvent is removed from the DAO. "Resins" as used herein, means resins that have been separated and obtained from a SDA unit. Resins are denser or heavier than deasphalted oil, but lighter than the aforementioned asphaltenes. The resin product usually comprises more aromatic hydrocarbons with highly aliphatic substituted side chains, and can also comprise metals, such as nickel and vanadium. Generally, the resins comprise the material from which asphaltenes and DAO have been removed.

U.S. Pat. No. 3,775,292 to Watkins teaches a SDA process where feedstock is deasphalted using a solvent, and then the resin is removed using a selective solvent in a solvent extraction unit so as to provide solvent-lean resin concentrate and a de-resined second liquid phase. Neither solvent is recovered, as the resin and the DAO is further processed in a hydrocracking unit so as to produce lower boiling hydrocarbons.

U.S. Pat. No. 4,101,415 to Crowley and U.S. Pat. No. 4,686,028 to Ven Driesen et al. teach similar SDA processes where a feedstock is subjected to a solvent extraction step that removes both the asphaltenes and the resin, resulting in an asphaltene-free and resin-free DAO. The asphaltene/resin mixture removed from the feedstock is then subjected to a second solvent extraction step that separates the resins from the asphaltenes.

U.S. Pat. No. 4,239,616 to Gearhart teaches a SKA process where a heavy hydrocarbon material is mixed with a solvent and then subjected to a first separation zone at elevated temperature and pressure so as to effect a separation of the material into a first light phase comprising oils, resins, and solvent, and a first heavy phase comprising asphaltenes and some solvent. The first light phase is sent to a second separation zone where it is subjected to temperatures higher than those in the first separation zone so as to effect a separation of the of the first light phase into a second light phase comprising oil and solvent and a second heavy phase comprising resins and some solvent. The second light phase is then sent to a third separation zone where it is separated into a third light phase comprising solvent and a third heavy phase comprising oils.

A key element of the '616 process is that at least a portion of the first heavy phase is introduced into the upper portion of the second separation zone. This is done so as to contact the first heavy phase with the second light phase and remove at least a portion of any resinous bodies that may be entrained in the second light phase. It is also preferred that the first heavy phase is sufficiently heated prior to its introduction into the second separation zone so as to cause the formation of internal reflux within the upper portion of the second separation zone, thus assisting in resin removal from the second light phase.

U.S. Pat. No. 4,454,023 to Lutz teaches a process whereby a heavy viscous hydrocarbon feed is processed in a visbreaker unit and fed to a distillation unit for fractionation. The bottoms product of the distillation unit is then fed to a solvent extraction unit producing a heavy asphaltene fraction as well as one or more lighter fractions which contain a large percentage of resins or oils. At least a portion of the lighter fractions that contains resin is recycled back to the feed stream to the visbreaker so as to increase the conversion in the visbreaker.

U.S. Pat. No. 5,145,574 to Hedrick teaches a process separating a resin phase from a solvent solution containing a solvent, DAO, and resin. The solvent solution is introduced into a special heat-exchange apparatus and directed over at least a portion of a generally vertically positioned heat-exchange surface thereby heating the solvent solution to precipitate the resin phase. A solvent solution having a reduced resin content is then recovered, as well as a resin product.

A separate, deasphalted resin product makes a better feed for heavy hydrocarbon cracking units such as H-OIL™, delayed cokers, and visbreaker units. Resin-free DAO is also an improved feedstock for product cracking units such as hydrotreaters, hydrocrackers, and catalytic cracking units.

H-OIL™ is a proprietary ebullated bed process (co-owned by Hydrocarbon Research, Inc. and Texaco Development Corporation) for the catalytic hydrogenation of heavy vacuum residuum, or "resid," and heavy oils to produce upgraded distillate petroleum products and an unconverted bottoms product particularly suited for blending to a low sulfur fuel oil. In the H-OIL™ process, a catalyst is contacted with hydrogen and a sulfur- and metal-containing hydrocarbon feedstock by means which insures that the catalyst is maintained at essentially isothermal conditions and exposed to a uniform quality of feed. This hydroprocessing process is particularly effective in achieving high levels of hydrodesulfurization with vacuum resid feedstocks. The H-OIL™ product is characterized as a liquid product of lower density and average boiling point, lower sulfur content, and lower content of metals.

High conversion is difficult at times because resid feedstocks typically contain high concentrations of metals such as nickel, iron and vanadium as well as high concentrations of nitrogen and sulfur. Many of these materials can even deactivate or poison catalysts. Poisoning of the catalyst often leads to the need for frequent catalyst additions or changeouts which impact unit availability and throughput. Resid conversion also is difficult because resid feedstocks contain a large asphaltene fraction that produces insoluble carbonaceous material when the feedstock is heated. Formation of these solids often results in feedstock or temperature operating limitations. Resin feedstocks are lower in metals content and asphaltenes, and are thus better feedstocks for the H-OIL™ process than resids.

The delayed coking process is an established petroleum refinery process which is used on very heavy low value resid feeds, such as vacuum residue, to obtain lower boiling cracked products. In the delayed coking process, the heavy oil feedstock is heated rapidly in a tubular furnace from which it flows directly to a large coking drum which is maintained under conditions at which coking occurs under a slight pressure. In the drum, the heated feed decomposes to form coke, gas and desired lower boiling liquids which are removed from the top of the drum and passed to a fractionator. When the coke drum is full of solid coke, the feed is switched to another drum and the full drum is cooled and emptied of the coke product. Generally, at least two coking drums are used so that one drum is being charged while coke is being removed from the other.

Coking in the furnace is a significant problem in delayed coking operations. Higher temperatures in the coking drums can reduce the yields of coke and gas. The furnace provides the higher temperatures, leading to excessive fouling in the furnace tubes, thus leading to a greater maintenance requirement to clean the furnace tubes.

Various modifications have been made in the basic delayed coking process. For example, U.S. Pat. No. 4,455,219 to Janssen et al, and U.S. Pat. No. 4,518,487 to Graf et al, both incorporated herein by reference, provides modifications to the delayed coking process by replacing some of the heavy feed with lower boiling range hydrocarbons. These procedures result in improved coking processes in which increased liquid products are obtained with a corresponding reduction in coke yield. Thus, resin feedstocks are better feeds for a delayed coking unit than resids because of the lighter nature of the resins, as well as their propensity to reduce coking in the furnace.

Visbreaking (a term of art used as an abbreviation for "viscosity reduction") is a mild cracking operation used to reduce the viscosity of resid by converting the resid to lighter hydrocarbon fractions. The resid is sometimes blended with valuable light oil, or cutter stocks, to produce oils of acceptable viscosity. By the use of visbreakers, the viscosity of the resid is reduced so as to lower the requirement of the cutter stock. To improve process economics, visbreaking is generally preformed at high temperatures and pressures so as to increase conversion of the heavy residue. Depending on the severity of the visbreaking operation, coking and fouling of equipment may occur during the visbreaking reaction, which limits the ability to increase the severity of the visbreaking operation. Thus, for a given feedstock, the greatest conversion could be achieved by increasing severity; however, such increase in severity may adversely affect product quality and/or the rate of coke formation, whereby the ability to increase conversion by increasing severity is limited. Examples of a visbreaking process can be found in U.S. Pat. No. 5,925,236 to Fersing, et al., U.S. Pat. No. 5,413,702 to Yan, both incorporated herein by reference, and numerous others.

Various schemes have been proposed for increasing the severity of a visbreaking operation. For example, U.S. Pat. No. 4,454,023 to Lutz, incorporated herein by reference, proposes to increase the severity of a visbreaking operation by subjecting heavy product from the operation to a solvent extraction step to produce, as separate fractions, solvent extracted oil, resin and asphaltene, with the resin fraction being recycled to a visbreaking operation to permit an increase in severity. In general, resins are preferred feedstocks over asphaltenes for these types of units due to their reduced viscosity, lower solids content, and because they allow a visbreaking operation to run at more severe conditions. U.S. Pat. No. 4,767,521 to Feldman, et al., incorporated herein by reference, proposed to increase the severity of visbreaking by removing some heavy components from the visbreaker feed.

The hydrocracking unit is the most versatile of refinery conversion units. It can process a wide range of feedstocks from naphtha to asphalt to yield any desired product with a molecular weight lower than that of the feedstock. Hydrotreating is the most widely used catalytic refinery process and can treat feedstocks from the lightest naphthas to the heaviest vacuum resids. It is used primarily to remove undesired impurities, such as sulfur containing compounds, from the feedstocks. Both hydrocracking and hydrotreating utilize hydrogen as a reactant. Catalytic cracking is similar to hydrocracking, except that no hydrogen is used. In each process, a catalyst is used which can become deactivated by any metal or solid impurities found in the feedstock, as well as by any coke produced in the process.

Solid impurities also cause poor flow patterns in the reactors, as well as fouling, plugging, and blocking of conduits and downstream equipment. Oils laden with solids cannot be efficiently or readily pipelined. Buildup of solids can lead to equipment repair, shutdown, extended downtime, reduced process yield, decreased efficiency, and undesired coke formation. A resin-free DAO feedstock is, thus, preferred to a resin-containing DAO feedstock because, as stated above, in removing the resin portion of the DAO most of the metals, solids that remain after asphaltene removal and coke producers are also removed from the DAO.

SUMMARY OF THE INVENTION

One aspect of this invention provides an improved process for separating a resin phase from a solvent solution comprising a solvent, deasphalted oil (DAO) and resin. This improved process comprises heating the solvent solution so as to precipitate the resin from the solvent solution, and then separating the resin and some solvent from the solvent solution. This will produce a resin product and a mixture comprising the DAO and the remaining solvent. The DAO/solvent mixture is then boiled so as to vaporize a fraction of the solvent. The vaporized solvent is removed from the DAO/solvent mixture leaving a resin-free DAO product that contains any unvaporized solvent. The vaporized solvent is then condensed and recycled back to a solvent deasphalting phase to be reused in deasphalting a heavy hydrocarbon feedstock.

More specifically, this invention involves heat integration of a solvent deasphalting process with a gasification process.

The heat integration involves boiling the mixture of DAO and solvent using waste heat from a gasification unit, preferably heat from hot, saturated syngas. Resin removal is accomplished by heating the aforementioned solvent solution with the vaporized solvent fraction. The DAO/solvent mixture is also preheated with the vaporized solvent fraction prior to boiling. The solvent solution heating and DAO/solvent mixture preheating steps are usually done in series, where the DAO/solvent mixture is first preheated prior to the boiling step leaving a cooled vaporized solvent fraction. The cooled vaporized solvent fraction is then used to provide the heat to the solvent solution prior to the resin separation step. The asphalt that is recovered in the deasphalting step is then used as feedstock in the gasification process.

DESCRIPTION OF ILLUSTRATIVE EMBODIMENTS

Figure 1:
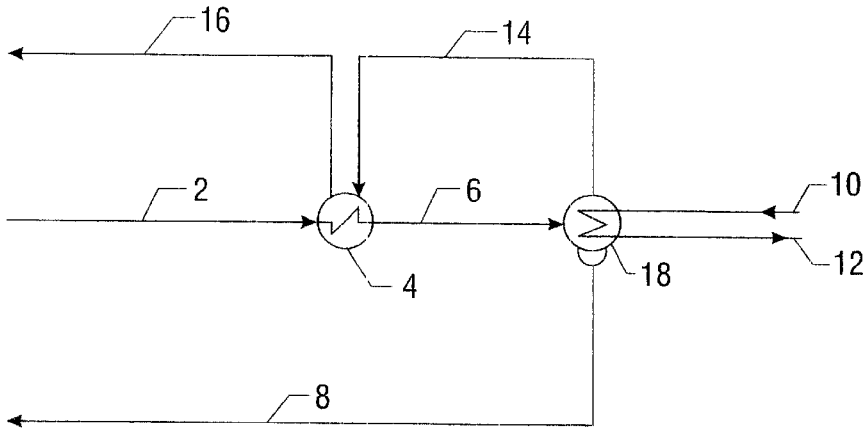
FIG. 1 is a schematic flow diagram of a common prior art process of solvent recovery without resin removal.

The present invention provides an integrated process of gasification and solvent deasphalting, with an emphasis on resin removal from deasphalted oil.

As used herein, the term "precipitate", in the context of precipitating asphaltenes, means the asphaltene-rich material forms a second phase, which may be and is preferably a fluid or fluid-like phase. In a preferred embodiment of this invention, the precipitated asphaltene-rich material is pumped to the gasifier.

As used herein, the terms "deasphalted hydrocarbon material", "deasphalted oil", DAO, and "paraffinic oil" are used interchangeably to refer to the oil soluble in the selected deasphalting solvents at the conditions selected for the deasphalting operation.

As used herein, the terms "syngas" or "synthesis gas" refer to gases comprising both hydrogen gas and carbon monoxide gas in amounts in excess of about 5 mole percent each. The mole ratio of hydrogen to carbon monoxide may, but need not necessarily, be about one to one. There are often some inerts in the synthesis gas, particularly nitrogen and carbon dioxide. There are often contaminants, such as hydrogen sulfide and COS. "Syngas" and "synthesis gas" are commonly produced in a gasification reaction.

As used herein, the term "hydrocarbonaceous" describes various suitable gasifier feedstocks is intended to include gaseous, liquid, and solid hydrocarbons, carbonaceous materials, and mixtures thereof. Asphaltenes are a component of the feedstock to the gasifier. It is often advantageous to mix feeds. In fact, substantially any combustible carbon-containing organic material, or slurries thereof, may be included within the definition of the term "hydrocarbonaceous". Solid, gaseous, and liquid feeds may be mixed and used simultaneously; and these may include paraffinic, olefinic, acetylenic, naphthenic, asphaltic, and aromatic compounds in any proportion.

Asphaltenes in oil makes further transportation and processing of the oil difficult. To maximize the value of heavy petroleum oils, separation of the asphalt components in the oil has been practiced for years. The non-asphaltene components are recovered and sold as valuable products leaving the asphaltene component that has very little value. Asphaltenes are a hydrocarbonaceous material suitable for gasification. See, for example, U.S. Pat. No. 4,391,701, the disclosure of which is incorporated herein by reference.

The process of this invention is applicable to an asphaltene-containing hydrocarbon material. This material is usually a fluid such as oil or a heavy oil. During the distillation of crude oil, as employed on a large scale in the refineries for the production of light hydrocarbon oil distillates, a residual oil is often obtained. The process is also applicable for this residual oil. The asphaltene-containing hydrocarbon material may even appear to be a solid, especially at room conditions. The asphaltene-containing hydrocarbon material should be at least partially miscible with the solvent at extraction temperatures.

The invention is the integration of a process of asphaltene extraction from an oil with a solvent, a process of gasification by partial oxidation, and a process resin removal from the asphaltene-free oil. By combining gasification with solvent deasphalting, the often unmarketable by-product asphaltenes can be converted into valuable synthesis gas.

In the solvent deasphalting process the deasphalted hydrocarbon material separated from the asphaltene-containing hydrocarbon material by liquid-liquid extraction with a solvent is a valuable feedstock for operations such as H-OIL™, visbreaker, coker, hydrotreater, hydrocracker, and catalytic cracking units. Furthermore, a resin phase removed from the deasphalted hydrocarbon material can significantly improve the quality of the feedstock the H-OIL™, visbreaker and coker units. The remaining resin-free deasphalted hydrocarbon material is itself an improved feedstock for hydrotreaters, hydrocrackers, and catalytic cracking units. The separated asphaltene-rich material, on the other hand, is much less valuable and is therefore ideal gasification feedstock.

The extraction of asphaltenes from an asphaltene-containing hydrocarbon material with a low-boiling solvent is known. See, for example, U.S. Pat. No. 4,391,701 and U.S. Pat. No. 3,617,481, the disclosures of which are incorporated herein by reference. The deasphalting step involves contacting the solvent with the asphaltene-containing hydrocarbon material in an asphaltene extractor. It is advantageous to maintain the temperature and pressure such that the asphaltene-containing hydrocarbon material and the low-boiling solvent are fluid or fluid like. The contacting may be done in batch mode, as a continuous fluid-fluid countercurrent mode, or by any other method known to the art. The asphaltenes form crystals and can be separated from the deasphalted hydrocarbon material via gravity separation, filtration, centrifugation, or any other method known to the art.

The process comprises contacting an asphaltene-containing hydrocarbon liquid with an alkane solvent to create a mixture. The amount of solvent is typically about 4 to about 8 parts per part on a weight basis. The temperature is typically between about 400° F. (204° C.) to about 800° F. (427° C.). The viscosity of the liquid is then reduced so that entrained solids can be removed from the mixture by, for example, centrifugation, filtering, or gravity settling. A pressurized sintered metal filter is a preferred method of separation. Then, the asphaltenes are precipitated into a separate fluid phase. The precipitation may be initiated by adding additional solvent, and/or the mixture heated, until asphaltenes precipitate into a separate phase. The substantially solids-free, i.e., less than about 150 parts per million by weight, asphaltenes are removed from the mixture. The recovered solids-free asphaltenes are subsequently gasified.

Gasifying precipitated asphaltenes and other hydrocarbonaceous fuels involve reacting them with a reactive oxygen-containing gas, such as air, substantially pure oxygen having greater than about 90 mole percent oxygen, or oxygen enriched air having greater than about 21 mole percent oxygen. Substantially pure oxygen is preferred. The partial oxidation of the hydrocarbonaceous material is completed, advantageously in the presence of a temperature control moderator such as steam or water, in a gasification zone to obtain the hot partial oxidation synthesis gas. The gasification processes are known to the art. See, for example, U.S. Pat. No. 4,099,382 and U.S. Pat. No. 4,178,758, the disclosures of which are incorporated herein by reference.

In the reaction zone, the contents will commonly reach temperatures in the range of about 1,700° F. (927° C.) to 3,000° F. (1649° C.), and more typically in the range of about 2,000° F. (1093° C.) to 2,800° F. (1538° C.). Pressure will typically be in the range of about 1 atmospheres (101 kPa) to about 250 atmospheres (25331 kPa), and more typically in the range of about 15 atmospheres (1520 kpa)to about 150 atmospheres (15,199 kPa), and even more typically in the range of about 60 atmospheres (6080 kPa) to about 80 atmospheres (8106 kPa).

Synthesis gas mixtures comprise carbon monoxide and hydrogen. Hydrogen is a commercially important reactant for hydrogenation reactions. Other materials often found in the synthesis gas include hydrogen sulfide, carbon dioxide, ammonia, cyanides, and particulates in the form of carbon and trace metals. The extent of the contaminants in the feed is determined by the type of feed and the particular gasification process utilized as well as the operating conditions. In any event, the removal of these contaminants is critical to make gasification a viable process, and acid gas, i.e., hydrogen sulfide, removal is very advantageous.

As the product gas is discharged from the gasifier, it is usually subjected to a cooling and cleaning operation involving a scrubbing technique wherein the gas is introduced into a scrubber and contacted with a water spray which cools the gas and removes particulates and ionic constituents from the synthesis gas. The resultant wet syngas, at a temperature of about 400° F. (about 204° C.) to about 500° F. (about 260° C.) is then further cooled to about 300° F. (about 149° C.) in a boiler used to vaporize and recover solvent in the solvent recovery step of the solvent deasphalting process. The cooled wet syngas is then treated in an acid gas removal step to remove contaminants gas prior to utilization of the synthesis gas in a downstream process.

The solvent used in the solvent deasphalting process can be any suitable deasphalting solvent. Typical solvents used for deasphalting are light aliphatic hydrocarbons, i.e., compounds having between two and eight carbon atoms. Alkanes, particularly solvents that contain propane, butanes, pentanes, or mixtures thereof, are useful in this invention. The particularly preferred solvents depend on the particular characteristics of the asphaltenes. Heavier solvents are used for higher asphalt Ring and Ball softening point asphaltenes. Solvents may contain a minor fraction, i.e., less than about 20%, of higher boiling alkanes such as hexanes or heptanes.

After deasphaltation, a solvent solution comprising deasphalted oil, resins, and solvent is processed to remove and recover the resin phase. This solvent solution can contain anywhere from 40% to over 90% solvent, with the remainder comprising the deasphalted oil and resins. Resin recovery is accomplished by first heating the solvent solution, preferably with vaporized solvent from the subsequent solvent recovery step. The hot solvent solution is then sent to a separator, where the solubility change that occurs as the mixture is heated allows the resin to precipitate out from the solvent solution. The precipitated resin is then removed from the separator, usually in the mixture of about 50% resin and 50% solvent. The recovered resin is then usually pumped to a heavy hydrocarbon cracking unit, such as an H-OIL™ unit, a coker unit, or a visbreaker unit.

After resin removal, the deasphalted oil/solvent mixture is then processed to recover the solvent. Solvent recovery can is generally done via supercritical separation or distillation, but in the instant invention it is accomplished by simply heating the resin-free deasphalted oil/solvent mixture to a sufficient temperature to boil off a fraction of the solvent. In the instant invention, the heat for the boiling is provided by the wet syngas product from the gasification unit. Preferably, the vaporized solvent is used to preheat the deasphalted oil/solvent mixture prior to the boiling step. This cools the vaporized solvent, and the cool vaporized solvent is then used to heat the aforementioned solvent solution consisting of resin, deasphalted oil, and solvent prior to the resin removal step. Most deasphalting solvents are then recycled, so the vapor from the resin removal heating step is condensed, and sent back to the deasphalting step for further processing.

Generally, not all the solvent is boiled away from the deasphalted oil. Usually a fraction of the solvent remains with the deasphalted oil, as the deasphalted oil product is usually about 50% solvent and 50% deasphalted oil. This mixture is then usually sent to a product cracking unit such as a hydrotreater, hydrocracker, or catalytic cracking unit for further processing.

Referring to the drawings, FIG. 1 illustrates a common prior art process for solvent removal and recovery from deasphalted oil. A deasphalted oil (DAO) and solvent mixture produced from a solvent deasphalting process is fed to heat exchanger 4 through line 2. The mixture is preheated in heat exchanger 4, and then sent to boiler 18 via line 6. In boiler 18, the mixture is heated using heat supplied by a heat transfer fluid, such as hot oil or steam, via line 10. The heat transfer fluid is cooled in boiler 18 and removed via line 12. The mixture is heated to a sufficient temperature to boil a fraction of the solvent in the mixture, which leaves the boiler through line 14. The heated mixture of DAO and remaining solvent leaves the boiler through line 8, for further processing.

The vaporized solvent fraction in line 14 supplies the heat to the heat exchanger 4, which is used to preheat the DAO/solvent mixture prior to boiling. The vaporized solvent fraction is cooled in heat exchanger 4 and leaves through line 16. The cooled vaporized solvent in line 16 is then commonly sent to a condenser so it can be recycled back to the prior solvent deasphalting process in liquid form.

In the prior art process as illustrated in FIG. 1, no resin fraction is removed from the DAO.

Figure 2:
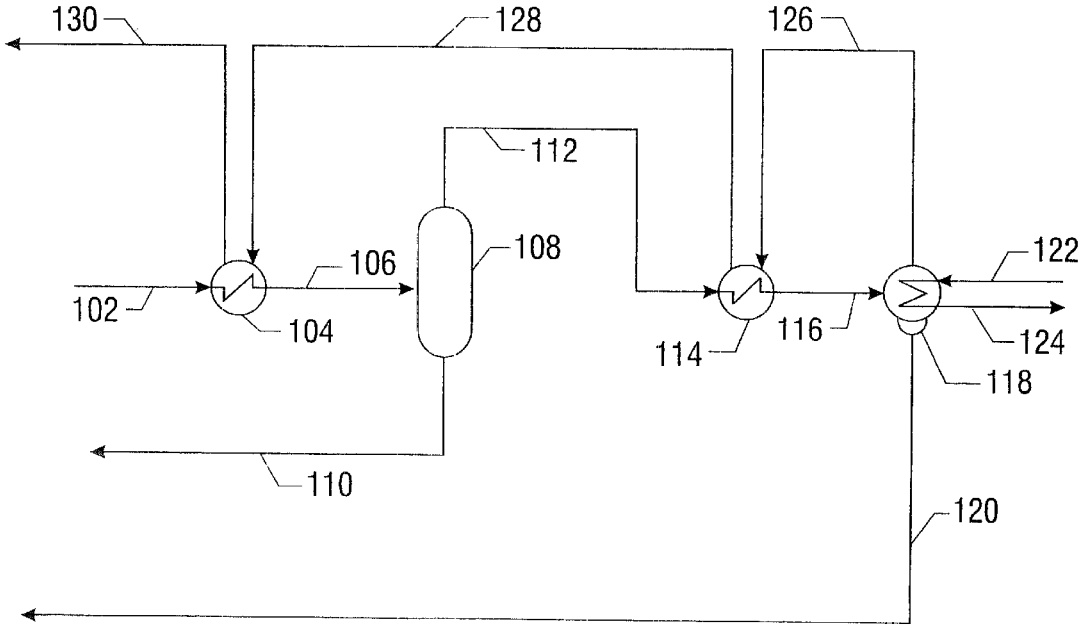
FIG. 2 is a schematic flow diagram of an embodiment of this invention, illustrating an integrated resin removal and solvent recovery process.

FIG. 2 illustrates one embodiment of the present invention, in which there is resin removal from a DAO/solvent mixture produced by a solvent deasphalting process.

Resin recovery is accomplished by sending the mixture via line 102 to heat exchanger 104 for heating. The mixture is heated in heat exchanger 104, and then sent to separator 108 via line 106. The solubility change that occurs as the mixture is heated allows the resin to precipitate out from the solvent solution and settle in the bottom of separator 108.

The precipitated resin is then removed from the separator through line 110, usually with a fraction of the solvent, and sent to other refinery units for processing, such as a heavy hydrocarbon cracking unit like an H-OIL™ unit, a coker unit, or a visbreaker unit.

After resin removal, the remaining deasphalted oil/solvent mixture flows from separator 108 to heat exchanger 114 through line 112. The mixture is preheated in heat exchanger 114, and then sent to boiler 118 via line 116. In boiler 118, the mixture is heated using heat supplied by a heat transfer fluid, such as hot oil or steam, but preferably hot synthesis gas from a gasification unit, via line 122. The heat transfer fluid is cooled in boiler 118 and removed via line 124. The mixture is heated to a sufficient temperature to boil a fraction of the solvent in the mixture, which leaves the boiler through line 126. The heated mixture of DAO and remaining solvent leaves the boiler through line 120, for further processing, usually in a product cracking unit such as a hydrotreater, hydrocracker, or catalytic cracking unit.

The vaporized solvent fraction in line 126 first supplies the heat to the heat. exchanger 114, which is used to preheat the resin free DAO/solvent mixture prior to boiling. The vaporized solvent fraction is cooled in heat exchanger 114 and leaves through line 128. The cooled vaporized solvent in line 128 is then further cooled in heat exchanger 104, which is used to heat the resin containing DAO/solvent mixture prior to the resin precipitation/removal step. The further cooled vaporized solvent is removed from heat exchanger 104 through line 130, where it is then commonly sent to a condenser so it can be recycled back to the prior solvent deasphalting process in liquid form.

Figure 3:
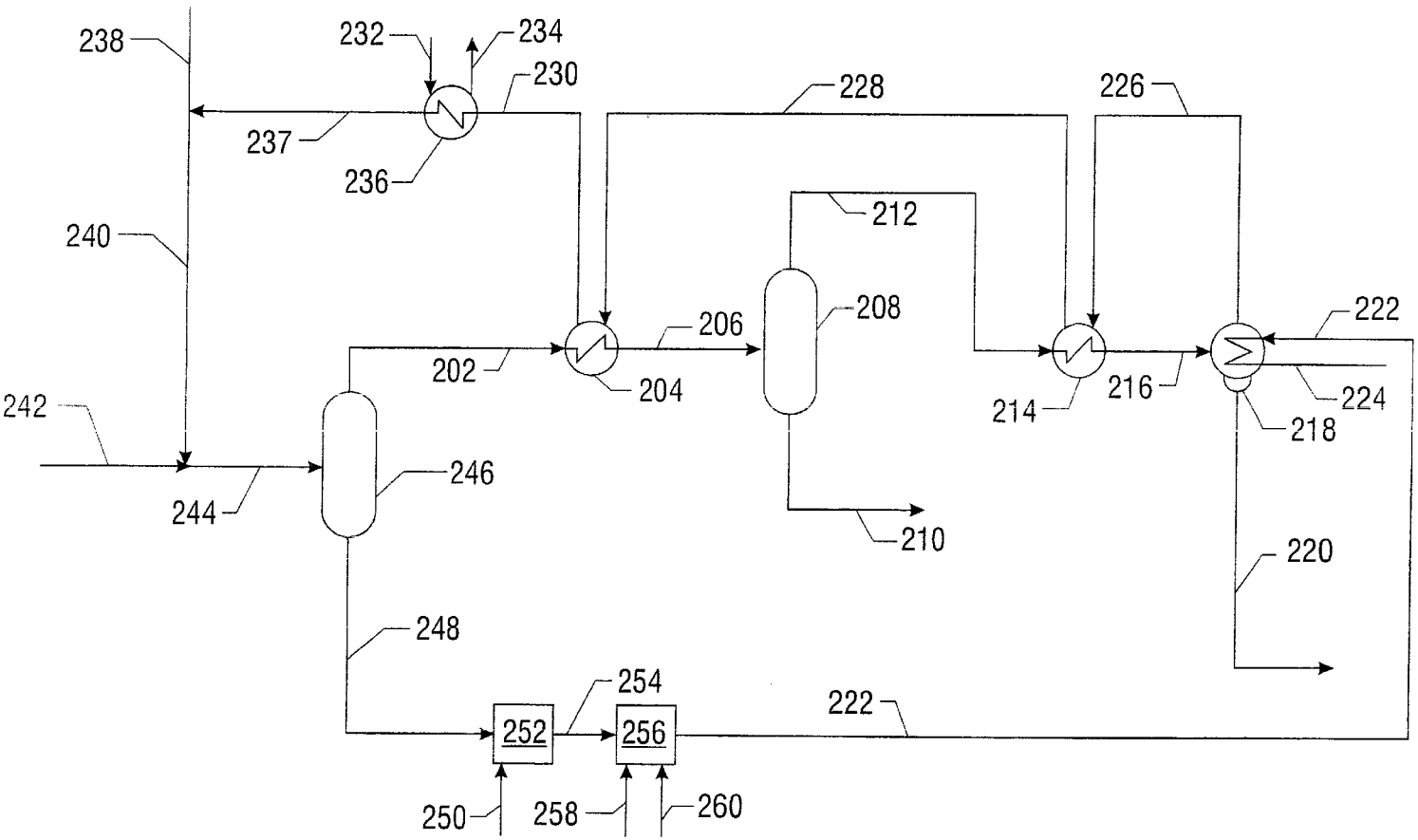
FIG. 3 is a schematic flow diagram of the preferred embodiment of this invention, illustrating an integrated gasification/solvent deasphalting system.

FIG. 3 illustrates another embodiment of the present invention, resin removal from a DAO/solvent mixture produced by a solvent deasphalting process integrated with a gasification process.

In this embodiment, an asphaltene containing oil in line 242 is contacted with a is solvent from line 240 to create a mixture. The solvent in line 240 is commonly a combination of fresh solvent from line 238 and recycled, condensed solvent from line 237. The asphaltene-containing oil/solvent mixture is then sent to separator 246, where the asphaltenes are allowed to precipitate into a separate fluid phase and are removed from separator 246 through line 248. The deasphalted oil/solvent is removed from separator 246 through line 202, where it is then processed for resin and solvent recovery.

The precipitated asphaltenes are then sent to a liquefaction unit 252 via line 248. This step may not be necessary if the downstream gasification unit 256 is equipped to handle solid feed. In the liquefaction unit 252, the precipitated asphaltenes are contacted with water from line 250 to form a slurry, which is removed from the liquefaction unit 252 through line 254. The slurry in line 254 is then sent to gasification unit 256, where it is reacted with an oxygen-containing gas from line 258 and a temperature control moderator, such as steam, from line 260. The slurry from in line 254 may also be combined with another gasifier feedstock prior to processing in the gasification reactor 256. In gasification reactor 256, a hot, wet synthesis gas mixture comprising carbon monoxide and hydrogen is produced and removed from the gasification reactor through line 222.

Resin recovery from the DAO is accomplished by sending the DAO/solvent mixture from separator 246 via line 202 to heat exchanger 204 for heating. The mixture is heated in heat exchanger 204, and then sent to separator 208 via line 206. The solubility change that occurs as the mixture is heated allows the resin to precipitate out from the solvent solution and settle in the bottom of separator 208. The precipitated resin is then removed from the separator through line 210, usually with a fraction of the solvent, and sent to other refinery units for processing, such as a heavy hydrocarbon cracking unit like an H-OIL™ unit, a coker unit, or a visbreaker unit.

After resin removal, the remaining deasphalted oil/solvent mixture flows from separator 208 to heat exchanger 214 through line 212. The mixture is preheated in heat exchanger 214, and then sent to boiler 218 via line 216. In boiler 218, the mixture is heated using heat supplied by wet synthesis gas from gasification unit 260, via line 222. The hot synthesis gas is cooled in boiler 218 and removed via line 224. The mixture is heated to a sufficient temperature to boil a fraction of the solvent in the mixture, which leaves the boiler through line 226. The heated mixture of DAO and remaining solvent leaves the boiler through line 220, for further processing, usually in a product cracking unit such as a hydrotreater, hydrocracker, or catalytic cracking unit.

The vaporized solvent fraction in line 226 first supplies the heat to the heat exchanger 214, which is used to preheat the resin free DAO/solvent mixture prior to boiling. The vaporized solvent fraction is cooled in heat exchanger 214 and leaves through line 228. The cooled vaporized solvent in line 228 is then further cooled in heat exchanger 204, which is used to heat the resin containing DAO/solvent mixture prior to the resin precipitation/removal step. The further cooled vaporized solvent is removed from heat exchanger 204 through line 230 and then sent condenser 236. In condenser 236, the further cooled vaporized solvent exchanges heat with a cooling medium, such as cooing water, which enters condenser 236 through line 232 and leaves through line 234. The condensed solvent leaves condenser 236 through line 237, where it is then combined with fresh solvent in line 238 for use in the solvent deasphalting process.

In view of the above disclosure, one of ordinary skill in the art should understand and appreciate that one illustrative embodiment includes a method for removing resin and solvent from a solvent solution comprising deasphalted oil, the resin, and the solvent, said method comprising heating the solvent solution so as to precipitate the resin; separating the resin from the solvent solution, producing a resin product and a mixture comprising the deasphalted oil and the solvent; boiling the mixture so as to vaporize a fraction of the solvent; and removing the vaporized solvent fraction from the mixture leaving a resin-free deasphalted oil product.

The solvent solution can comprise about 10% deasphalted oil and resin, and 90% solvent. A fraction of the solvent may be removed with the resin product, and can comprise about 50% resin and about 50% solvent. The remaining DAO/solvent mixture can be boiled by exchanging heat with waste heat from a gasification unit, usually supplied by wet syngas at a temperature of about 400° F. (204° C.) to about 500° F. (about 260° C.) that is cooled to a temperature of about 300° F. (149° C.).

The vaporized solvent fraction from the boiler can be used to preheat the DAO/solvent mixture and used to heat the DAO/resin/solvent solution, usually in series with the heating of the DAO/solvent mixture coming first. The resulting resin-free deasphalted oil product can comprise about 50% deasphalted oil and 50% solvent.

The resulting resin product can be processed in a heavy hydrocarbon cracking unit selected from the group consisting of a H-oil unit, a coker unit and a visbreaker unit. The resin-free deasphalted oil product can be further processed in a product cracking unit selected from the group consisting of a hydrotreater unit, a hydrocracker unit and a catalytic cracking unit.

In view of the above disclosure, one of ordinary skill in the art should understand and appreciate that a second illustrative embodiment includes a method for integrating a solvent deasphalting process and a gasification process comprising adding a solvent to a heavy hydrocarbon stream comprising asphaltenes, resin, and oil; removing the asphaltenes so as to produce a substantially solvent-free asphaltene stream and a substantially asphaltene-free solvent solution comprising the solvent, the resin, and the oil; processing the asphaltenes in a partial oxidation reactor so as to produce syngas; heating the solvent solution so as to precipitate the resin; separating the resin from the solvent solution, producing a resin product and a mixture comprising the oil and the solvent; applying heat to the mixture so as to vaporize a fraction of the solvent wherein the syngas is used as the heat source; and removing the vaporized solvent fraction from the mixture leaving a resin-free deasphalted oil product.

The solvent solution can comprise about 10% deasphalted oil and resin, and 90% solvent. A fraction of the solvent may be removed with the resin product, and can comprise about 50% resin and about 50% solvent. The remaining DAO/solvent mixture can be boiled by exchanging heat with waste heat from a gasification unit, usually supplied by wet syngas at a temperature of about 400° F. (204° C.) to about 500° F. (about 260° C.) that is cooled to a temperature of about 300° F. (149° C.).

The vaporized solvent fraction from the boiler can be used to preheat the DAO/solvent mixture and used to heat the DAO/resin/solvent solution, usually in series with the heating of the DAO/solvent mixture coming first. The vaporized solvent is then condensed, combined with fresh solvent, and added to the heavy hydrocarbon stream comprising asphaltenes, resin, and oil for further use in the deasphalting process. The resulting resin-free deasphalted oil product can comprise about 50% deasphalted oil and 50% solvent.

The resulting resin product can be processed in a heavy hydrocarbon cracking unit selected from the group consisting of a H-oil unit, a coker unit and a visbreaker unit. The resin-free deasphalted oil product can be further processed in a product cracking unit selected from the group consisting of a hydrotreater unit, a hydrocracker unit and a catalytic cracking unit.

While the devices, compositions and methods of this invention have been described in terms of preferred embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A method for removing resin and solvent from a solvent solution comprising deasphalted oil, the resin, and the solvent, said method comprising:

a) heating the solvent solution so as to precipitate the resin;

b) separating the resin from the solvent solution, producing a resin product and a mixture comprising the deasphalted oil and the solvent;

c) boiling the mixture so as to vaporize a fraction of the solvent, wherein the mixture is boiled by exchanging heat with waste heat from a gasification unit; and d) removing the vaporized solvent fraction from the mixture leaving a resin-free deasphalted oil product.

2. The method of claim 1 wherein at least a fraction of the solvent is removed with the resin product.

3. The method of claim 2 wherein the resin product comprises about 50% resin and about 50% solvent.

4. The method of claim 1 wherein the waste heat from a gasification unit is supplied by wet syngas.

5. The method of claim 4 wherein the wet syngas is at a temperature of about 400° F. (204° C.) to about 500° F. (about 260° C.).

6. The method of claim 5 wherein the wet syngas is cooled to a temperature of about 300° F. (149° C.).

7. The method of claim 1 further comprising exchanging heat between the mixture and the vaporized solvent fraction prior to boiling the mixture giving a cooled vaporized solvent fraction.

8. The method of claim 7 wherein the solvent solution is heated by exchanging heat between the solvent solution and the cooled vaporized solvent fraction.

9. The method of claim 1 wherein the solvent solution is heated by exchanging heat between the solvent solution and the vaporized solvent fraction.

10. The method of claim 1, wherein the resin product is further processed in a heavy hydrocarbon cracking unit selected from the group consisting of an ebullated bed unit, a coker unit and a visbreaker unit.

11. The method of claim 1 wherein the resin-free deasphalted oil product is further processed in a product cracking unit selected from the group consisting of a hydrotreater unit, a hydrocracker unit and a catalytic cracking unit.

12. The method of claim 1 wherein the resin-free deasphalted oil product comprises about 50% deasphalted oil and about 50% solvent.

13. The method of claim 1 wherein the solvent solution comprises about 10% deasphalted oil and resin, and about 90% solvent.

14. A method for integrating a solvent deasphalting process and a gasification process comprising:

a) adding a solvent to a heavy hydrocarbon stream comprising asphaltenes, resin, and oil;

b) removing the asphaltenes from the heavy hydrocarbon stream so as to produce a substantially solvent-free asphaltene stream and a substantially asphaltene-free solvent solution comprising the solvent, the resin, and the oil;

c) processing the asphaltenes in a partial oxidation reactor so as to produce wet syngas;

d) heating the solvent solution so as to precipitate the resin;

e) separating the resin from the solvent solution, producing a resin product and a mixture comprising the oil and the solvent;

f) applying heat to the mixture so as to vaporize a fraction of the solvent wherein the wet syngas is used as the heat source; and g) removing the vaporized solvent fraction from the mixture leaving a resin-free deasphalted oil product.

15. The method of claim 14 wherein at least a fraction of the solvent is removed with the resin product.

16. The method of claim 15 wherein the resin product comprises about 50% resin and about 50% solvent.

17. The method of claim 14 wherein the wet syngas is at a temperature of about 400° F. (204° C.) to about 500° F. (about 260° C.).

18. The method of claim 15 wherein the wet syngas is cooled to a temperature of about 300° F. (149° C.).

19. The method of claim 14 further comprising exchanging heat between the mixture and the vaporized solvent fraction prior to applying heat to the mixture giving a cooled vaporized solvent fraction.

20. The method of claim 19 wherein the solvent solution is heated by exchanging heat between the solvent solution and the cooled vaporized solvent fraction.

21. The method of claim 14 wherein the solvent solution is heated by exchanging heat between the solvent solution and the vaporized solvent fraction.

22. The method of claims 14, wherein the resin product is further processed in a heavy hydrocarbon cracking unit selected from the group consisting of an ebullated bed unit, a coker unit and a visbreaker unit.

23. The method of claim 14 wherein the resin-free deasphalted oil product is further processed in a product cracking unit selected from the group consisting of a hydrotreater unit, a hydrocracker unit and a catalytic cracking unit.

24. The method of claim 14 wherein the resin-free deasphalted oil product comprises about 50% deasphalted oil and about 50% solvent.

25. The method of claim 14 wherein the solvent solution comprises about 10% deasphalted oil and resin, and about 90% solvent.

26. The method of claim 14 wherein the vaporized solvent is condensed, combined with the solvent, and added to the heavy hydrocarbon stream comprising asphaltenes, resin, and oil.

* * * * *